US010098489B2

(12) United States Patent
Mustafa et al.

(10) Patent No.: US 10,098,489 B2
(45) Date of Patent: Oct. 16, 2018

(54) WARDROBE HANGER ROD ASSEMBLY

(71) Applicants: Afzaal Mustafa, Islamabad (PK); Hamza Afzaal, Toronto (CA)

(72) Inventors: Afzaal Mustafa, Islamabad (PK); Hamza Afzaal, Toronto (CA)

( * ) Notice: Subject to any disclaimer, the term of this patent is extended or adjusted under 35 U.S.C. 154(b) by 0 days.

(21) Appl. No.: 15/684,300

(22) Filed: Aug. 23, 2017

(65) Prior Publication Data

US 2018/0055264 A1 Mar. 1, 2018

Related U.S. Application Data

(60) Provisional application No. 62/380,651, filed on Aug. 29, 2016.

(51) Int. Cl.
*A47G 25/06* (2006.01)

(52) U.S. Cl.
CPC ..... *A47G 25/0692* (2013.01); *A47G 25/0685* (2013.01)

(58) Field of Classification Search
CPC ..... A47G 25/0692; A47G 25/0685; A47G 25/54; A47G 25/74; D06F 57/12; A47B 55/02; A47B 96/06; A47J 37/0694; F25D 25/02; F25D 2325/021; F25D 2325/023; F25D 2331/803
See application file for complete search history.

(56) References Cited

U.S. PATENT DOCUMENTS 573,835 A * 12/1896 Taylor ..... A47G 25/743 211/119
2,097,349 A * 10/1937 Sladek ..... E05C 17/443 16/33
2,319,470 A * 5/1943 Nobles ..... F25D 25/02 211/153
2,433,275 A * 12/1947 Higby, Sr. ..... A47G 25/0685 211/104
2,534,380 A * 12/1950 Schwartzman ..... A47G 25/54 206/285
2,561,841 A * 7/1951 Cart ..... A45C 3/004 206/279
2,635,764 A 4/1953 Mattocks
2,643,003 A * 6/1953 Christie ..... A47G 25/74 206/287
2,645,541 A * 7/1953 Mintz ..... A47G 25/54 206/285
4,178,844 A * 12/1979 Ward ..... A47J 37/0694 108/102
4,712,692 A * 12/1987 Peinsipp ..... D06F 57/12 211/119
5,019,126 A 5/1991 Post
(Continued)

*Primary Examiner* — Ko H Chan
(74) *Attorney, Agent, or Firm* — Global Intellectual Property Agency, LLC; Daniel Boudwin

(57) ABSTRACT

A hanger rod assembly for hanging clothes in a wardrobe. The hanger rod assembly includes a hanger rod frame having a first hanger rod, a second hanger rod and a third hanger rod. The first hanger rod, the second hanger rod and the third hanger rod are each parallel to one another. A plurality of stabilization rods is movably affixed to the first hanger rod. An elongation frame can be telescopically secured to the hanger rod frame, allowing the wardrobe hanger rod assembly to extend to fit wardrobes of diverse sizes. A plurality of hooks is affixed to the hanger rod frame and the elongation frame.

15 Claims, 9 Drawing Sheets

(56) References Cited

U.S. PATENT DOCUMENTS

| | | | | | |
|---|---|---|---|---|---|
| 5,520,118 | A * | 5/1996 | McCarthy | A47B 55/02 | 108/152 |
| 5,645,178 | A | 7/1997 | Conley | | |
| 6,164,194 | A * | 12/2000 | Westmoreland | A47J 37/0694 | 211/181.1 |
| 6,244,448 | B1 * | 6/2001 | Hang | A47K 10/04 | 211/104 |

* cited by examiner

WARDROBE HANGER ROD ASSEMBLY

CROSS REFERENCE TO RELATED APPLICATIONS

This application claims the benefit of U.S. Provisional Application No. 62/380,651 filed on Aug. 29, 2016. The above identified patent application is herein incorporated by reference in its entirety to provide continuity of disclosure.

BACKGROUND OF THE INVENTION

The present invention relates to a hanger rod assembly. Specifically, the present invention provides a hanger rod assembly having a hanger rod frame with three hanger rods designed to increase the storage capacity of a wardrobe.

Many closets lack adequate storage space in which to hang clothing primarily due to only a single hanger rod system conventionally placed in closets or wardrobes. With the conventional single hanger rod system, storage space is limited to the length of a single hanger rod. A single hanger rod is easily overcrowded and weighed down by an abundance of clothing suspended therefrom, which in turn causes the rod to buckle or deform.

Several devices and strategies have been proposed to increase storage space in a closet. One device utilizes a series of hanging shelves that can be suspended from a hanger rod in a closet. A strategy used to increase storage space in a closet is to mount an additional hanger rod to the walls of a closet or wardrobe either below or above the existing hanger rod. These devices and strategies may increase the storage space of a wardrobe or closet, but do not utilize the space efficiently. Meaning, these solutions fail to recognize that by suspending additional hanger rods, e.g. with a frame having three or more hanger rods, from the existing hanger rod, a user can transform a single hanger rod into multiple hanger rods without the difficulty of mounting additional hanger rods into the walls of a closet or wardrobe.

SUMMARY OF THE INVENTION

In view of the foregoing disadvantages inherent in the known types of wardrobe hanger rod assemblies now present in the prior art, the present invention provides a suspendable wardrobe hanger rod assembly wherein the same can be utilized for providing convenience for the user when increasing the storage capacity of a wardrobe or closet with an existing hanger rod mounted in a wardrobe or closet. The wardrobe hanger rod assembly comprises a hanger rod frame having a first hanger rod, a second hanger rod and a third hanger rod. The second hanger rod is positioned between the first hanger rod and the third hanger rod. A plurality of hooks is affixed to the hanger rod frame and configured to suspend the hanger rod frame from an existing hanger rod mounted in a wardrobe or closet. A plurality of stabilization rods is affixed to the hanger rod frame and configured to extend outward from the hanger rod frame toward a rear wall and a floor of a closet or wardrobe.

One object of the present invention is to provide a wardrobe hanger rod assembly that enables as user to increase the storage space in a wardrobe on a single hanger rod to three or more hanger rods.

Another object of the present invention is to provide a plurality of stabilization rods suspended form one of the hanger rods to stabilize the wardrobe hanger rod assembly when suspended from an existing rod in a closet.

Another object of the present invention is to provide a plurality of hooks pivotally secured to a hanger rod frame, wherein each hook is configured to pivot between an upright position and a compacted position.

A further object of the invention is to provide a wardrobe hanger rod assembly comprising an elongated frame telescopically connected to a hanger rod frame, allowing the length of the assembly to be adjusted.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
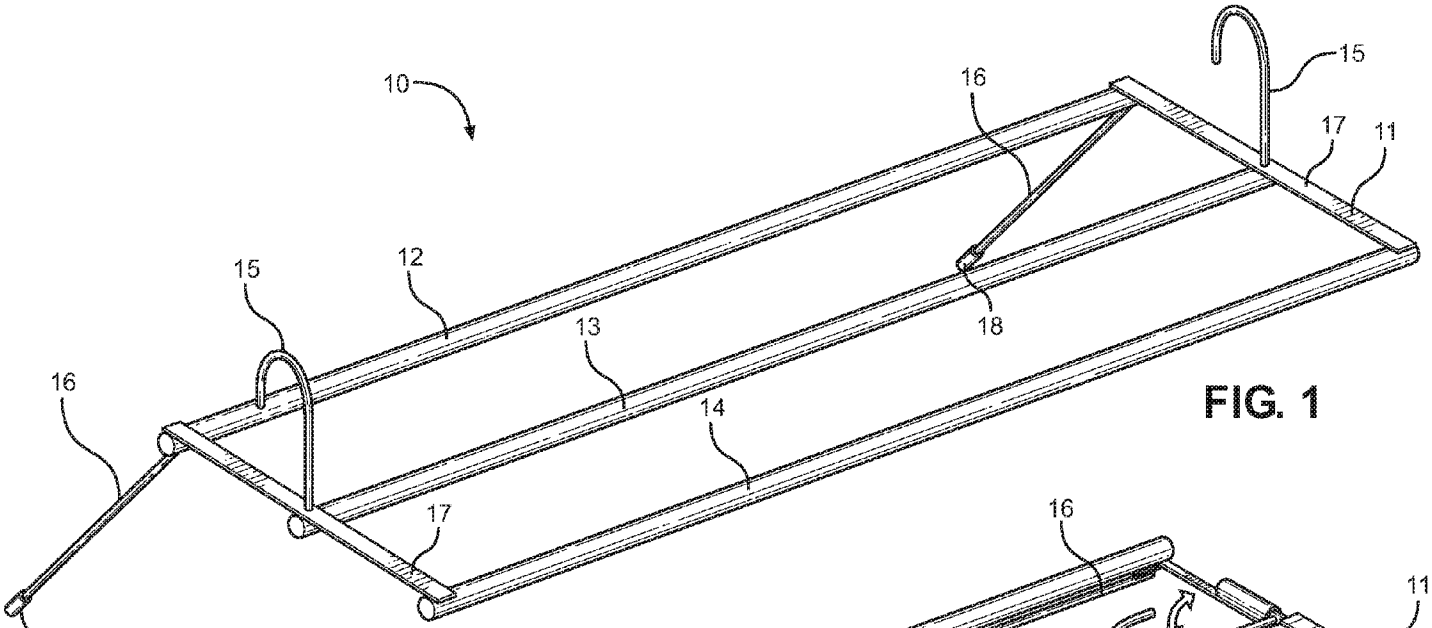
FIG. 1 shows a perspective view of a first embodiment of the wardrobe hanger rod assembly.

Reference is made herein to the attached drawings. Like reference numerals are used throughout the drawings to depict like or similar elements of the wardrobe hanger rod assembly. The figures are intended for representative purposes only and should not be considered to be limiting in any respect. Unless specifically limited to a single unit, "a" is intended to be equivalent to "one or more" throughout the present disclosure.

Referring now to FIG. 1, there is shown a perspective view of a first embodiment of the wardrobe hanger rod assembly. The wardrobe hanger rod assembly 10 comprises a hanger rod frame 11 having a first hanger rod 12, a second hanger rod 13 and a third hanger rod 14. In the illustrated embodiment, the second hanger rod 13 is disposed equidistantly between the first hanger rod 12 and the third hanger rod 14. A pair of cross members 17 is secured to each distal end of first hanger rod 12, the second hanger rod 13, and the third hanger rod 14. In other embodiments not illustrated here, the hanger rod frame 11 may have more than three hanger rods. In the illustrated embodiment, the wardrobe hanger rod assembly is constructed of metal rods but may be constructed using any rigid rod that supports the weight of the items suspended therefrom.

A plurality of hooks 15 is affixed to the hanger rod frame 11. In the illustrated embodiments, the plurality of hooks 15 is affixed to the second hanger rod 13 or the cross member 17 of the hanger rod frame 11. The plurality of hooks 15 is configured to removably secure the hanger rod frame 11 to an existing hanger rod or crossbeam within a closet or wardrobe.

A plurality of stabilization rods 16 is affixed to the hanger rod frame 11. In the illustrated embodiment, the plurality of stabilization rods 16 is affixed to the first hanger rod 12 of the hanger rod frame 11. Each stabilization rod 16 of the plurality of stabilization rods 16 extends outward from the hanger rod frame. The stabilization rods 16 are adapted to contact a rear wall of a wardrobe or closet when the wardrobe hanger rod assembly is disposed within the closet or wardrobe, thereby preventing the wardrobe hanger rod assembly from swaying when suspended from the existing hanger rod. A nub 18 is disposed on the distal end of each stabilization rod 16. In one embodiment, the nub 18 is fastened to the stabilization rod by a threaded connection. With the nub 18 connected by a threaded connection, the length of each stabilization rod 16 can be adjusted slightly by rotating the nub 18, allowing the nub 18 to rest against a rear wall of the closet or wardrobe. The nub 18 is adapted to reduce force applied to the rear wall of a wardrobe of closet when the wardrobe hanger rod assembly is disposed within the closet or wardrobe. The nub 18 can be made of rubber or other force dampening material.

Figure 2:
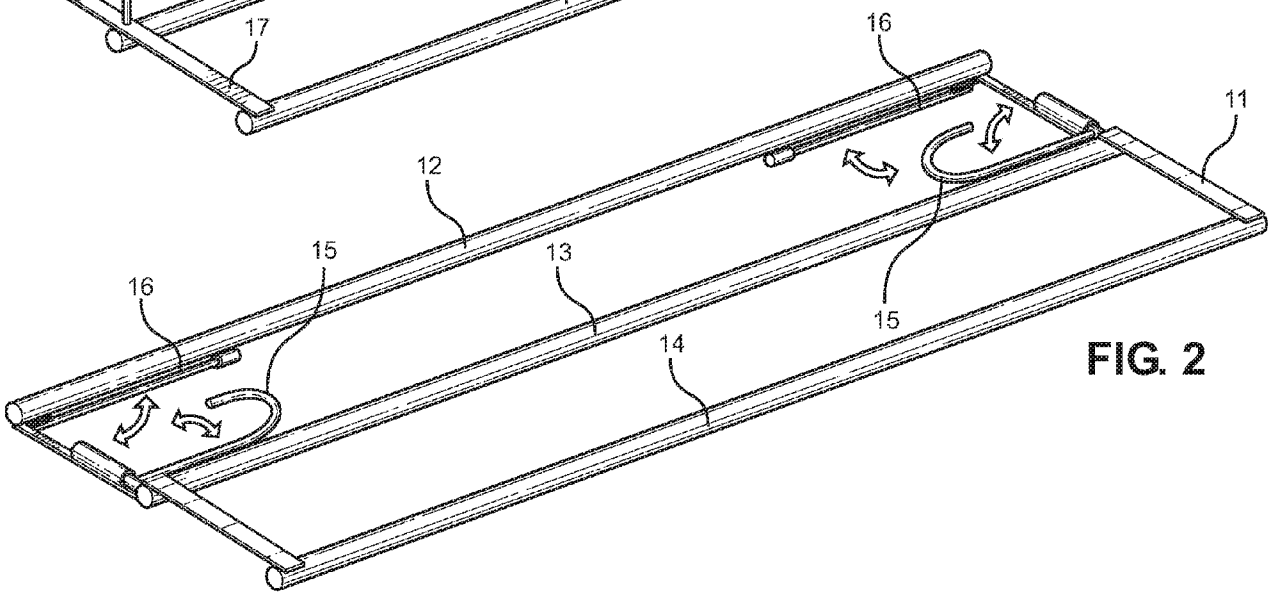
FIG. 2 shows a perspective view of a second embodiment of the wardrobe hanger rod assembly.
Figure 3:
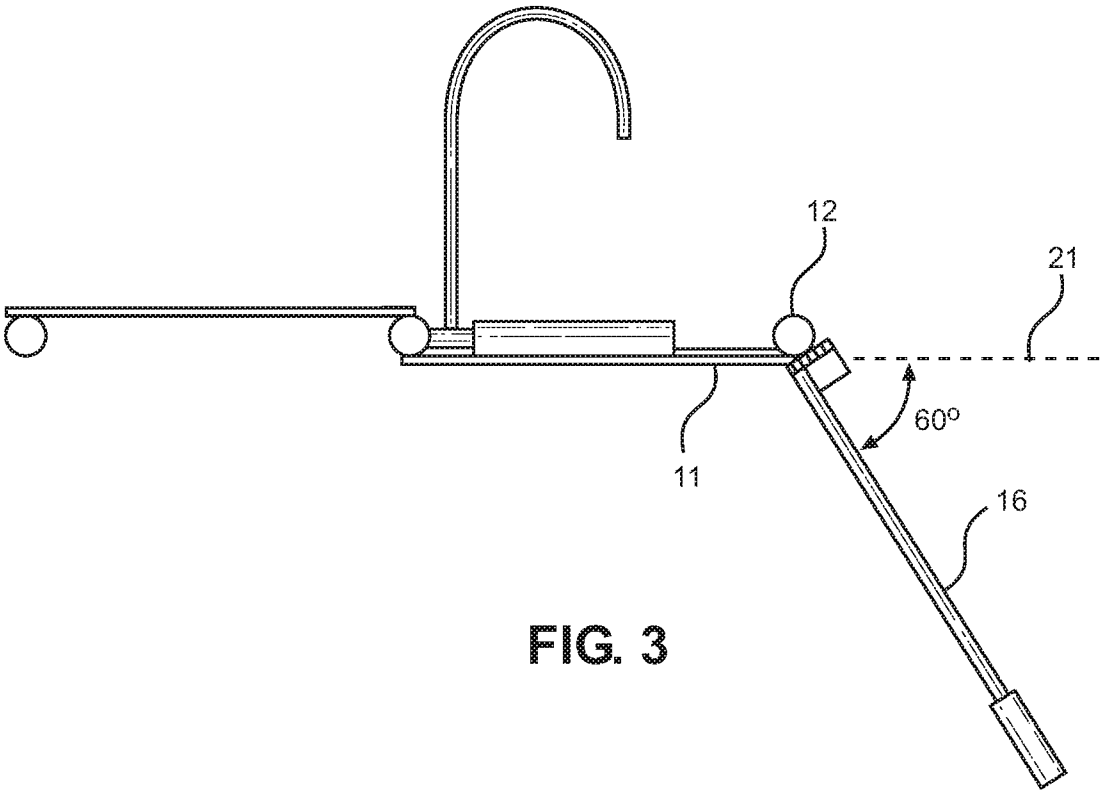
FIG. 3 shows side elevation view of a first embodiment of the wardrobe hanger rod assembly.

Referring now to FIG. 2, there is shown a second embodiment of the wardrobe hanger rod assembly. In the illustrated embodiment, the plurality of stabilization rods 16 is pivotally affixed to the hanger rod frame 11. Specifically, in this embodiment, the plurality of stabilization rods 16 is pivotally affixed to the first hanger rod 12. Each stabilization rod of the plurality of stabilization rods 16 is configured to pivot between a deployed position and a compact position. In the illustrated embodiment, the pivotal connection between the stabilization rods 16 and the first hanger rod 12 is accomplished with a hinge. When in a deployed position, each stabilization rod of the plurality of stabilization rods 16 extends outward at a 90-degree angle with respect to a longitudinal axis of the first hanger rod 12 and downward at a 60-degree angle with respect to a horizontal plane of the hanger rod frame 11, as shown in FIG. 3. However, in other embodiments, the angle that each stabilization rod 16 extends outward from the hanger rod frame varies.

Additionally, in the embodiment illustrated in FIG. 2, the plurality of hooks 15 is pivotally affixed to the hanger rod frame 11. Specifically, in this embodiment, the plurality of hooks 15 is pivotally affixed to the second hanger rod 13. Each hook of the plurality of hooks 15 is configured to pivot between a deployed position and a compact position. In the compact position, each hook 15 rests relatively flat against the hanger rod frame 11. In the deployed position, each hook 15 is perpendicular to and extends upward from the hanger rod frame 11.

Figure 4A:
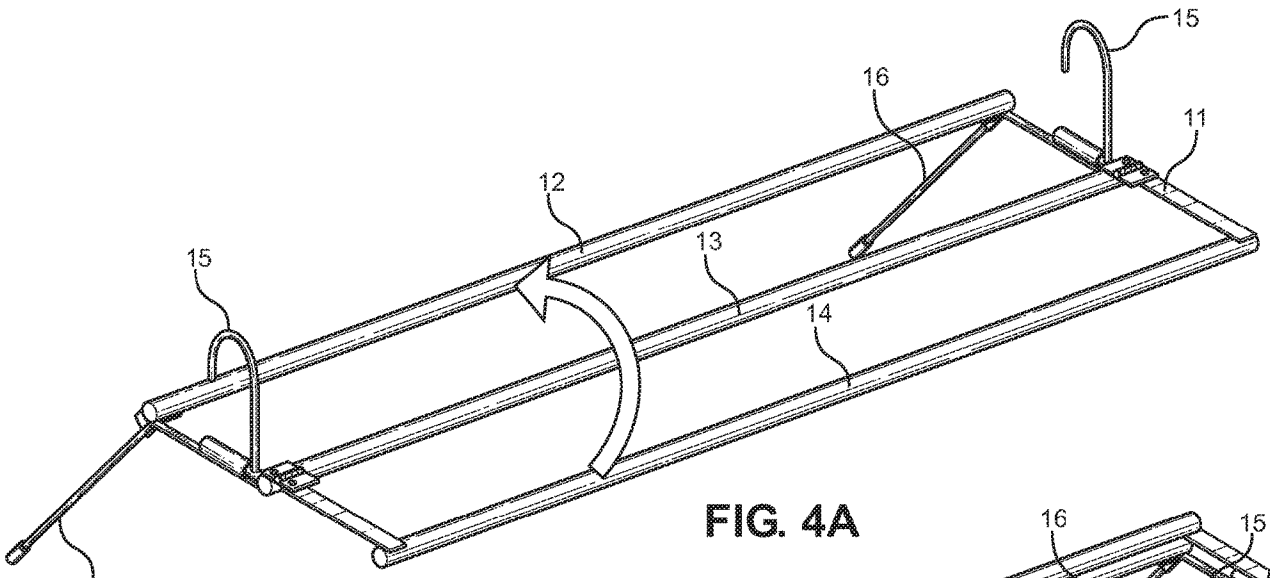
FIG. 4A shows a perspective view of a third embodiment of the wardrobe hanger rod assembly.
Figure 4B:
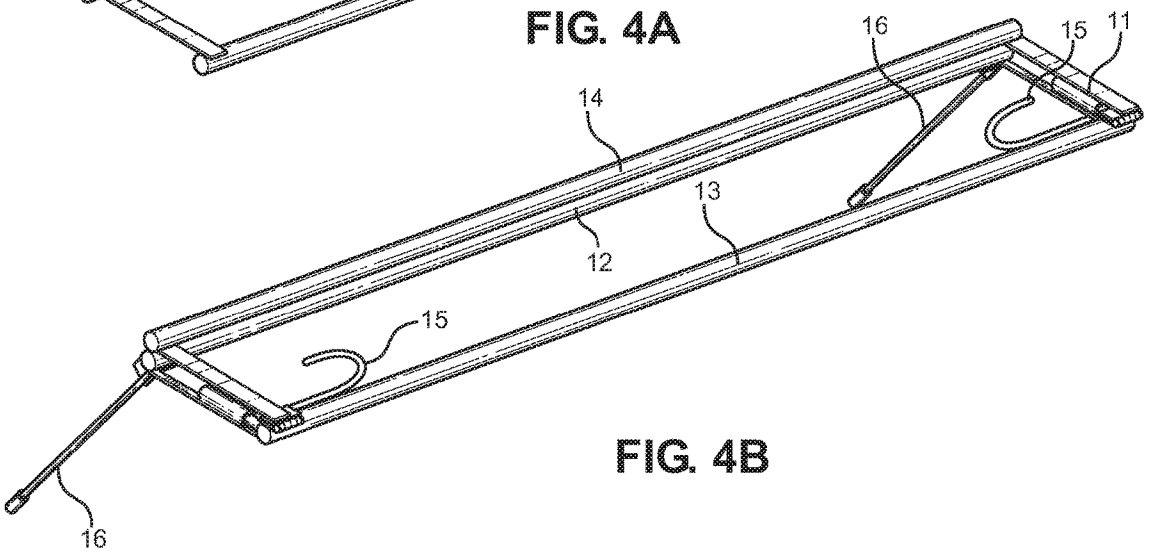
FIG. 4B shows an alternate perspective view of a third embodiment of the wardrobe hanger rod assembly.

Referring now to FIG. 4A, there is shown a perspective view of a third embodiment of the wardrobe hanger rod assembly. Some embodiments of the wardrobe hanger rod assembly are adjustable in width. In one such embodiment, the third hanger rod 14 is pivotally fastened to the second hanger rod 13. This arrangement allows the hanger rod frame 11 to move into a compact position by folding in half. In a deployed position, the third hanger rod 14 is parallel to the first hanger rod 12 and second hanger rod 13. In a compact position, as shown in FIG. 4B, the third hanger rod 14 rests directly above the first hanger rod 12.

Figure 5:
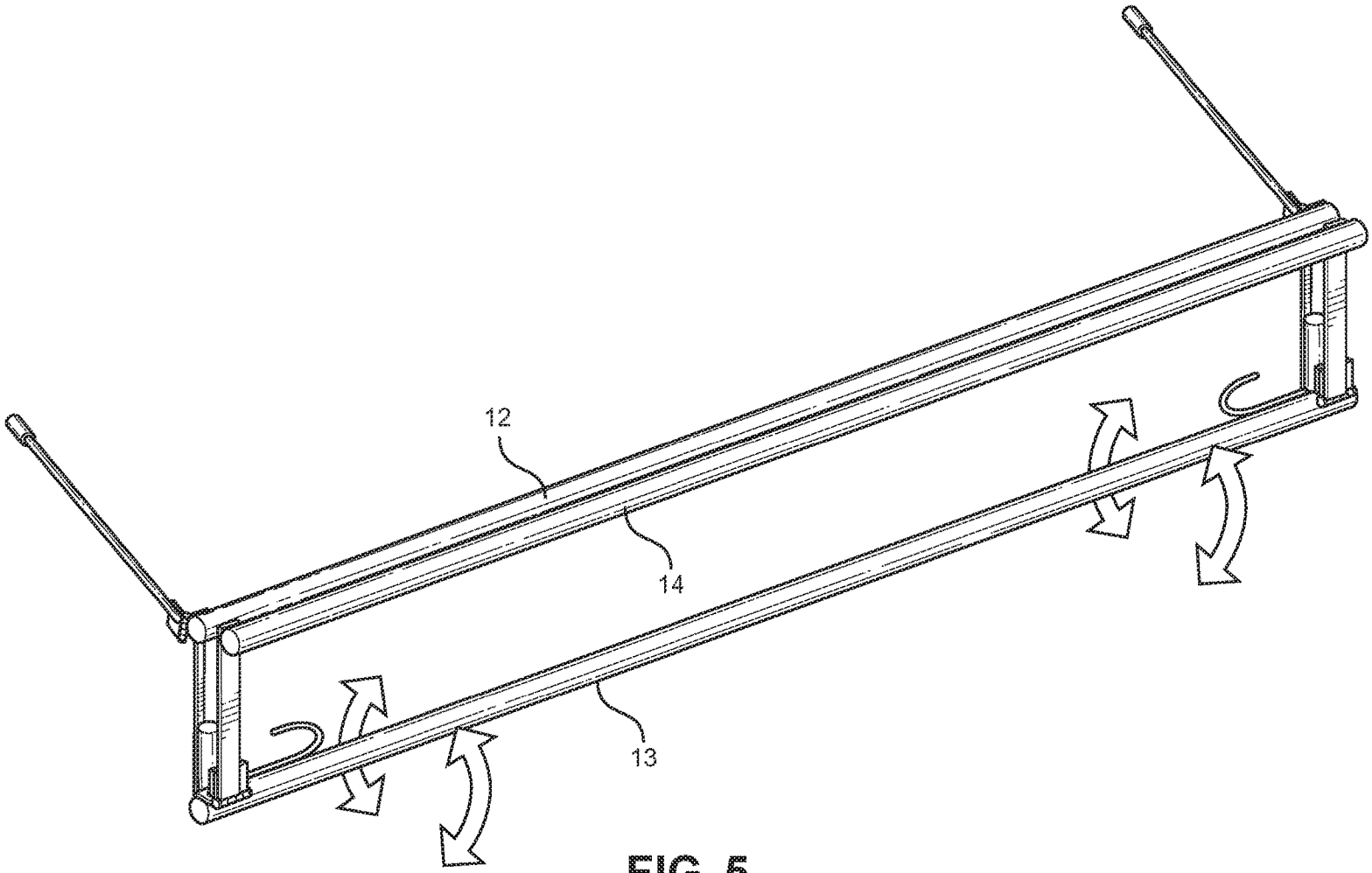
FIG. 5 shows a perspective view of a fourth embodiment of the wardrobe hanger rod assembly.

A fourth embodiment is shown in FIG. 5. In this illustrated embodiment, both the first hanger rod 12 and the third hanger rod 14 are pivotally fastened to the second hanger rod 13. The first hanger rod 12 and third hanger rod 14 pivot about the second hanger rod 13 an arcuate 90-degrees into a compact position from a deployed position, where the first hanger rod 12, the second hanger rod 13 and the third hanger rod 14 are parallel. In the compact position, the first hanger rod 12 and the third hanger rod 14 are above the second hanger rod.

Figure 6:
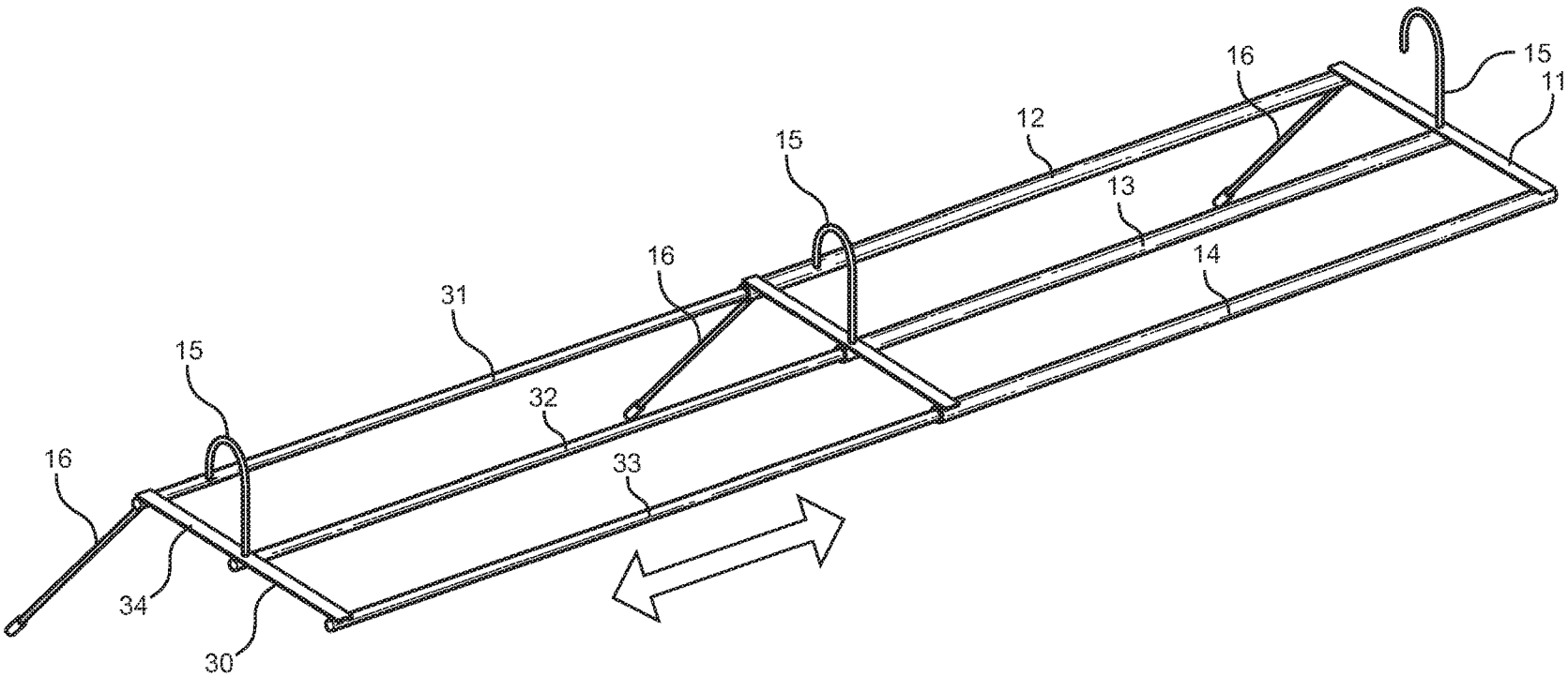
FIG. 6 shows a perspective view of a fifth embodiment of the wardrobe hanger assembly.

In some embodiments, as illustrated in FIG. 6, the wardrobe hanger assembly further comprises an elongation frame 30 secured to the hanger rod frame 11. The elongation frame 30 comprises a first elongation rod 31, a second elongation rod 32 and a third elongation rod 33. The second elongation rod 32 is disposed between the first elongation rod 31 and the third elongation rod 33. The elongation frame 30 aligns with the hanger rod frame 11 so that the first elongation rod 31 is telescopically mounted to the first hanger rod 12, the second elongation rod 32 is telescopically mounted to the second hanger rod 13 and the third elongation rod 33 is telescopically mounted to the third hanger rod 14. An elongation cross member 34 is secured to the distal end of first elongation rod, second elongation rod and third elongation rod.

A hook of the plurality of hooks 15 is affixed to the elongation frame 30. And, a stabilization rod of the plurality of stabilization rods 16 is affixed to the elongation frame 30. In embodiments where the plurality of hooks 15 and the plurality of stabilization rods 16 are pivotally affixed to the hanger rod frame 11, the hook of the plurality of hooks 15 and the stabilization rod of the plurality of stabilization rods 16 are also pivotally affixed to the elongation rod frame 30.

In certain embodiments having an elongation frame, as illustrated in FIG. 6, the elongation frame 30 is telescopically mounted within a hollow hanger rod frame 11. Here, the first elongation rod 31, second elongation rod 32 and third elongation rod 33 are equal in length to the first hanger rod 12, second hanger rod 13 and third hanger rod 14, respectively, doubling the length of the wardrobe hanger assembly when the elongation frame 30 is fully extended. In other embodiments, the first elongation rod 31, second elongation rod 32 and third elongation rod 33 can be shorter or longer than the first hanger rod 12, second hanger rod 13, and third hanger rod 14, respectively.

Figure 7A:
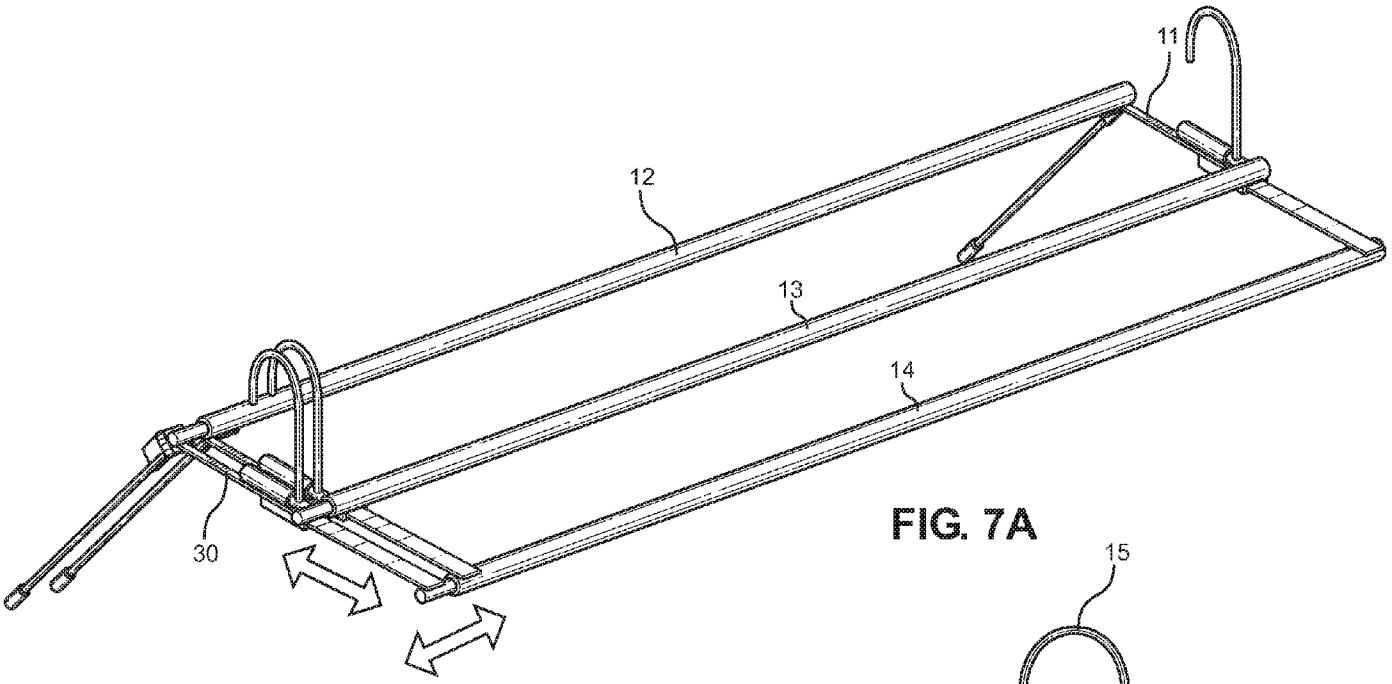
FIG. 7A shows a perspective view of a sixth embodiment of the wardrobe hanger assembly.
Figure 7B:
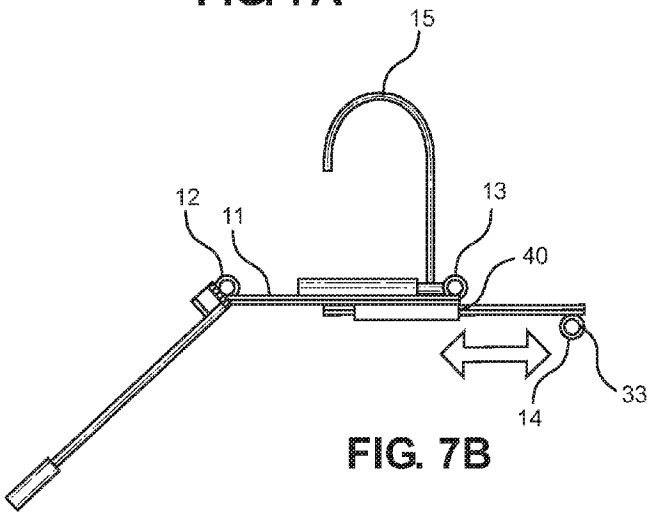
FIG. 7B shows a side elevation view of a sixth embodiment of the wardrobe hanger assembly.

Referring now to FIGS. 7A and 7B, there is shown a perspective view of a sixth embodiment of the wardrobe hanger assembly. In some embodiments of the wardrobe hanger assembly, the third hanger rod 14 is telescopically secured to the hanger rod frame 11, providing an embodiment of the wardrobe hanger rod assembly with adjustable depth. In one embodiment, such as the one illustrated in FIG. 7B, the third hanger rod 14 is telescopically secured to the hanger rod frame 11 via a pair of tracks 40 affixed to the hanger rod frame 11 opposite the plurality of hooks 15.

Figure 8:
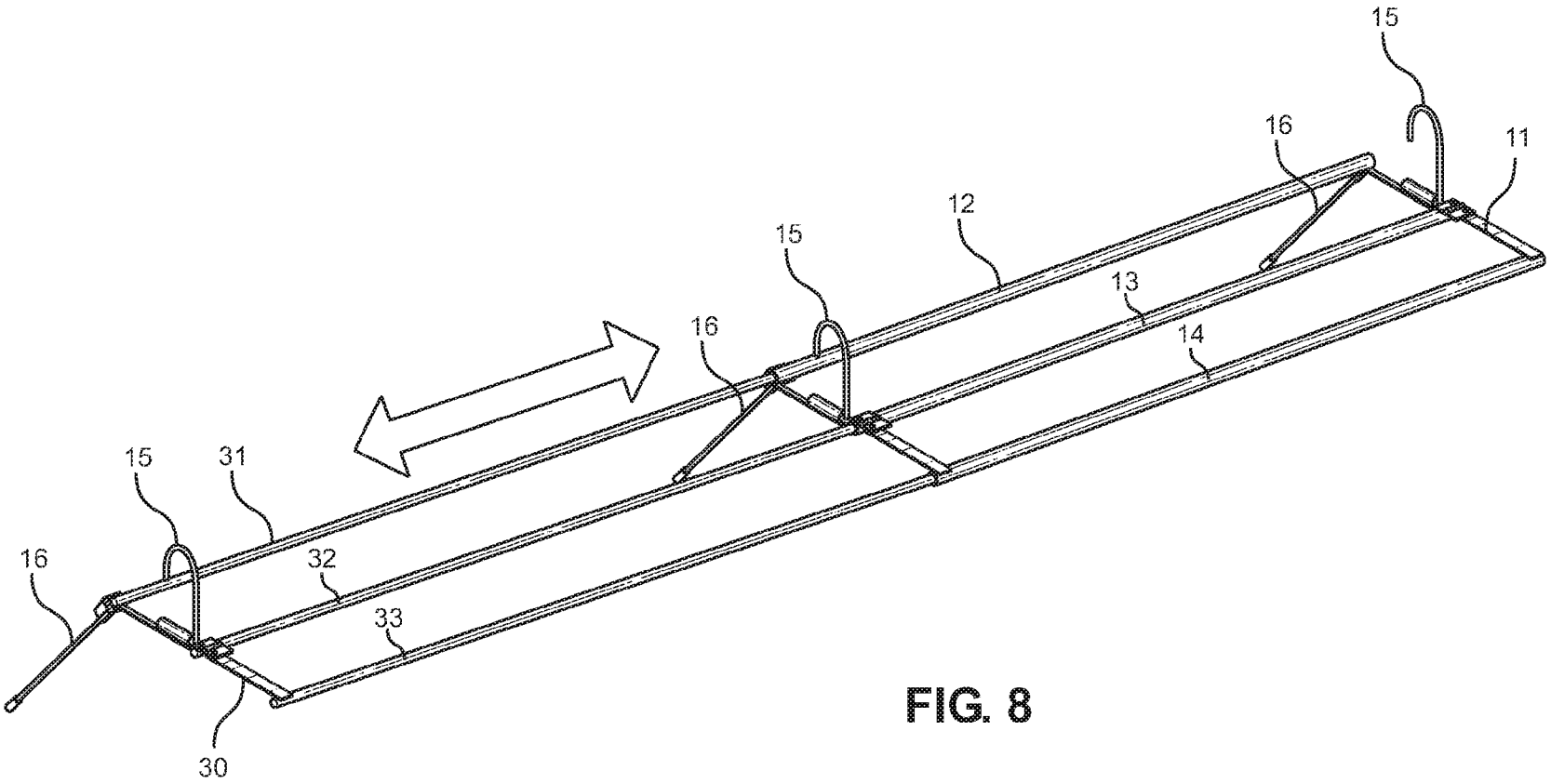
FIG. 8 shows a perspective view of a seventh embodiment of the wardrobe hanger assembly.

Certain extendable embodiments of the wardrobe hanger assembly having an elongation frame 11 are also foldable. In one of these embodiments, as shown in FIG. 8, the third hanger rod 14 and third elongation rod 33 are pivotally fastened to the second hanger rod 13 and the second elongation rod 32, respectively. Similar to the embodiment illustrated in FIG. 6, when this embodiment is in a deployed position the third hanger rod 14 is parallel to the first hanger rod 12 and the second hanger rod 13 and the third elongation rod 33 is parallel to the first elongation rod 31 and the second elongation rod 32. In a compact position, the third hanger rod 14 rests directly above the first hanger rod 12 and the third elongation rod 33 rests directly above the first elongation rod 31. In some of these embodiments, the plurality of hooks 15 and the plurality of stabilization rods 16 are also pivotally affixed to the hanger rod frame 11 and elongation rod frame 30.

Figure 9:
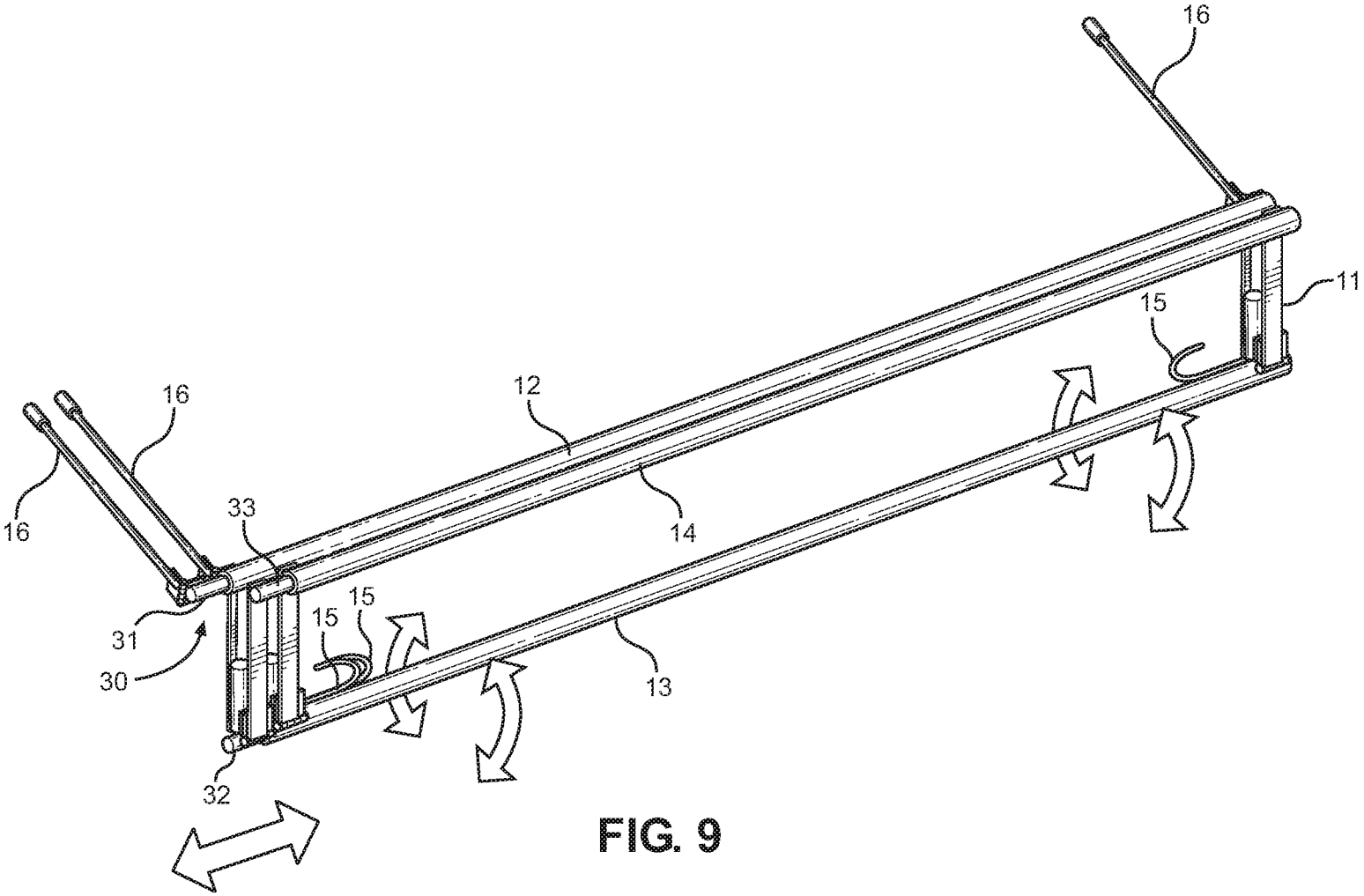
FIG. 9 shows a perspective view of an eighth embodiment of the wardrobe hanger assembly.

In an eighth embodiment, as shown in FIG. 9, the first hanger rod 12 and the third hanger rod 14 are pivotally fastened to the second hanger rod 13 and the first elongation rod 31 and third elongation rod 33 are pivotally fastened to the second elongation rod 32. In this embodiment, the wardrobe hanger rod assembly can pivot between a deployed position and a compact position. When in a deployed position, the first hanger rod 12, the second hanger rod 13 and the third hanger rod 14 are parallel, resulting in the first elongation rod 31, the second elongation rod 32 and the third elongation rod 33 being parallel. When in a compact position, the first hanger rod 12 and the third hanger rod 14 meet above the second hanger rod 13 in a stacked configuration, resulting in the first elongation rod 31 and the third elongation rod 33 meeting above the second elongation rod 32 in a stacked configuration. Additionally, in some of these embodiments, the plurality of hooks 15 and the plurality of stabilization rods 16 are also pivotally affixed to the hanger rod frame 11 and the elongation rod frame 30.

Figure 10:
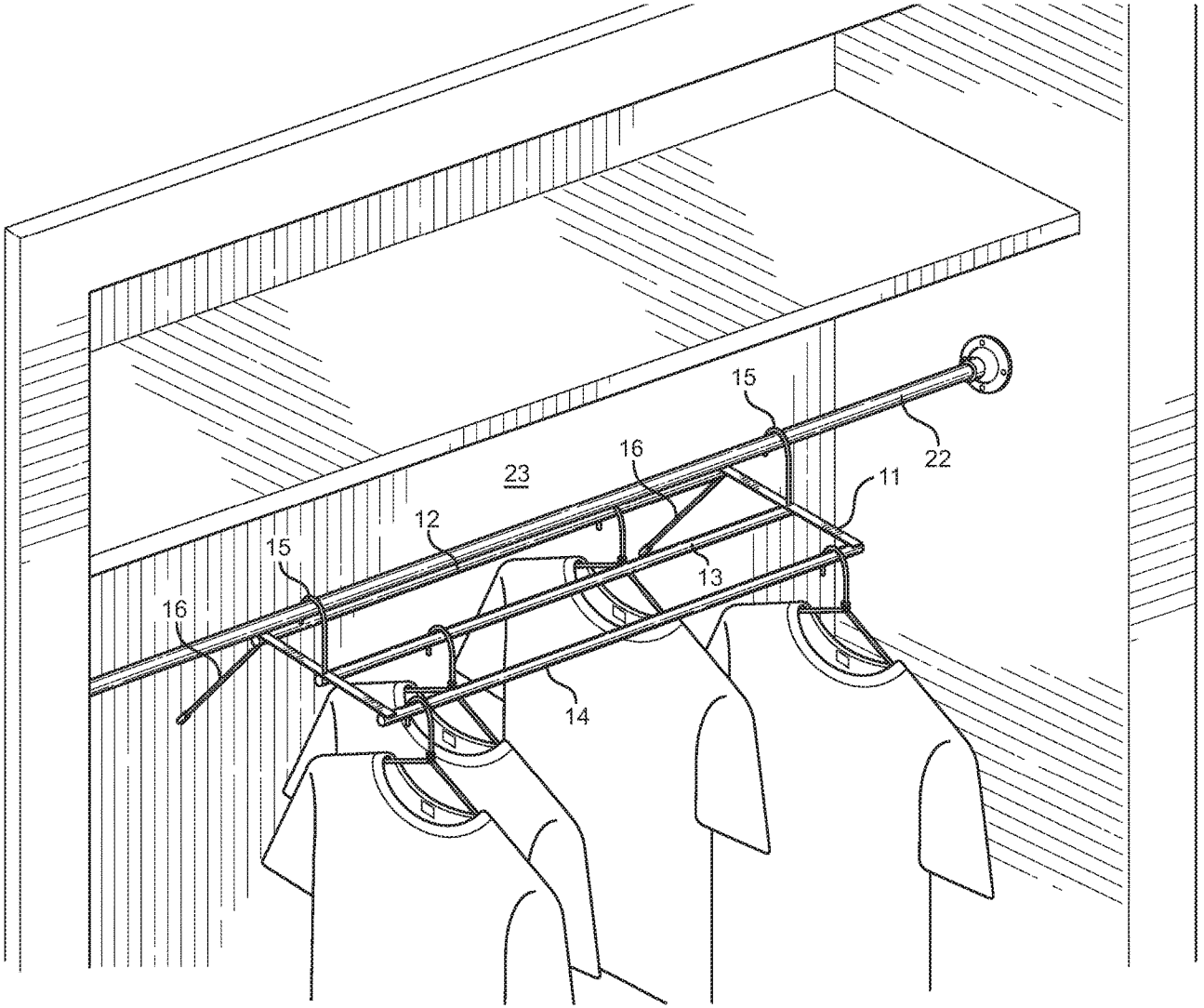
FIG. 10 shows a perspective view of an embodiment of the wardrobe hanger assembly in use.

Now referring to FIG. 10, there is shown a perspective view of an embodiment of the wardrobe hanger assembly in use. In use, the hanger rod frame 11 is suspended to an existing hanger rod 22 or crossbeam in a wardrobe or closet by the plurality of hooks 15. When suspended within a wardrobe or closet, the first hanger rod 12 is oriented closest to the rear wall surface 23 of the wardrobe or closet. This orientation allows the plurality of stabilization rods 16 to press against the surface of the rear wall 23 and stabilize the wardrobe hanger rod assembly when clothes are hung upon the hanger rod frame 11. To maximize the hanging space the wardrobe hanger rod assembly provides, a user should stagger the placement of hung clothes, for example, a user places the first clothes hanger on the third hanger rod 14, the second clothes hanger on the second hanger rod 13, the third clothes hanger on the first hanger rod 12 and then the fourth clothes hanger back on the third hanger rod 14 and so on.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A wardrobe hanger rod assembly, comprising:

a hanger rod frame having a first hanger rod, a second hanger rod, and a third hanger rod;

wherein the second hanger rod is disposed between the first hanger rod and the third hanger rod;

wherein the first hanger rod, the second hanger rod, and the third hanger rod are parallel when in a deployed position;

a plurality of hooks secured to the hanger rod frame, wherein the plurality of hooks is configured to secure the wardrobe hanger rod assembly to a crossbar;

a plurality of stabilization rods hingedly affixed to the first hanger rod of the hanger frame such that the plurality of stabilization rods are selectively movable between a deployed position and a folded position;

wherein the plurality of stabilization rods extend away from a horizontal plane of the hanger rod frame at a non-perpendicular angle when in the deployed position.

2. The wardrobe hanger rod assembly of claim 1, wherein the plurality of hooks is pivotally affixed to the hanger rod frame.

3. The wardrobe hanger rod assembly of claim 1, wherein the plurality of hooks is affixed to the second hanger rod.

4. The wardrobe hanger rod assembly of claim 1, wherein the third hanger rod is telescopically secured to the hanger rod frame.

5. The wardrobe hanger rod assembly of claim 1, wherein a nub is affixed to a distal end of each stabilization rod of the plurality of stabilization rods by a threaded connection.

6. The wardrobe hanger rod assembly of claim 1, further comprising:

an elongation frame telescopically secured to the hanger rod frame having a first elongation rod, a second elongation rod and a third elongation rod, wherein the second elongation rod is disposed between the first elongation rod and the third elongation rod;

wherein the first elongation rod is telescopically mounted to the first hanger rod, the second elongation rod is telescopically mounted to the second hanger rod and the third elongation rod is telescopically mounted to the third hanger rod;

wherein a hook of the plurality of hooks is affixed to the elongation frame;

wherein a stabilization rod of the plurality of stabilization rods is affixed to the elongation frame.

7. The wardrobe hanger rod assembly of claim 1, wherein the third hanger rod is pivotally fastened to the second hanger rod; wherein the first and second hanger rods are parallel to each other and the third hanger rod is parallel to the first and second hanger rods when in a deployed position.

8. The wardrobe hanger rod assembly of claim 1, wherein the first hanger rod and the third hanger rod are pivotally fastened to the second hanger rod; wherein the first hanger rod, the second hanger rod and the third hanger rod are parallel when in a deployed position.

9. The wardrobe hanger rod assembly of claim 6, wherein the third hanger rod and third elongation rod are pivotally fastened to the second hanger rod and the second elongation rod, respectively, wherein the first hanger rod, the second hanger rod and the third hanger rod are parallel to one another when in a deployed position.

10. The wardrobe hanger rod assembly of claim 6, wherein the first hanger rod and the third hanger rod are pivotally fastened to the second hanger rod and the first elongation rod and third elongation rod are pivotally fastened to the second elongation rod, wherein the first hanger rod, the second hanger rod and the third hanger rod are parallel when in a deployed position.

11. The wardrobe hanger rod assembly of claim 6, wherein the third hanger rod is telescopically secured to the hanger frame and the third elongation rod is telescopically secured to the elongation frame.

12. The wardrobe hanger rod assembly of claim 6, wherein the first elongation rod, second elongation rod and third elongation rod are equal in length to the first hanger rod, second hanger rod and third hanger rod, respectively.

13. The wardrobe hanger rod assembly of claim 7, wherein the third hanger rod is disposed on a separate plane from the first and second hanger rods.

14. The wardrobe hanger rod assembly of claim 6, further comprising an elongated cross-member affixed to each of the first elongation rod, the second elongation rod, and the third elongation rod, wherein the elongated cross-member is configured to provide structural support to the first, second, and third elongation rods.

15. The wardrobe hanger rod assembly of claim 14, wherein:

each of the first elongation rod, the second elongation rod, and the third elongation rod are configured to selectively move between an extended position and a retracted position; and wherein the first elongation rod, the second elongation rod, and the third elongation rod are slidably received within the first hanger rod, the second hanger rod, and the third hanger rod, respectively, such that the elongated cross-member rests against each of the first hanger rod, second hanger rod, and third hanger rod when in the retracted position.

* * * * *